US011293426B2

(12) United States Patent
Freiherr Varnbüler Von Und Zu Hemmingen-Redschlag et al.

(10) Patent No.: US 11,293,426 B2
(45) Date of Patent: Apr. 5, 2022

(54) PUMP DEVICE FOR DELIVERY OF AT LEAST ONE DELIVERY MEANS

(71) Applicant: qonqave GmbH, Wernau (DE)

(72) Inventors: Lars Freiherr Varnbüler Von Und Zu Hemmingen-Redschlag, Wiernsheim-Pinache (DE); Alois Krutzenbichler, Starnberg (DE); Raymond Ritschka, Weissach (DE); Jochen Baumann, Stuttgart (DE)

(73) Assignee: qonqave GmbH, Wernau (DE)

( * ) Notice: Subject to any disclaimer, the term of this patent is extended or adjusted under 35 U.S.C. 154(b) by 110 days.

(21) Appl. No.: 16/490,158

(22) PCT Filed: Mar. 2, 2018

(86) PCT No.: PCT/EP2018/055165
§ 371 (c)(1),
(2) Date: Aug. 30, 2019

(87) PCT Pub. No.: WO2018/158423
PCT Pub. Date: Sep. 7, 2018

(65) Prior Publication Data

US 2020/0256329 A1 Aug. 13, 2020

(30) Foreign Application Priority Data

Mar. 2, 2017 (DE) ..... 10 2017 104 400.0

(51) Int. Cl.
*F04B 43/04* (2006.01)
*F04B 43/00* (2006.01)

(52) U.S. Cl.
CPC ..... *F04B 43/04* (2013.01); *F04B 43/0054* (2013.01)

(58) Field of Classification Search
CPC ..... F04B 43/02; F04B 43/04; F04B 43/12; F04B 43/0054; F04B 43/123; F16J 3/02; F04C 5/00
(Continued)

(56) References Cited

U.S. PATENT DOCUMENTS 3,922,119 A 11/1975 Rosenquist
5,466,133 A * 11/1995 Tuck, Jr. ..... F04B 43/0054 417/474
(Continued)

FOREIGN PATENT DOCUMENTS

DE 102004011123 A1 3/2005
DE 102007005736 A1 8/2008
(Continued)

OTHER PUBLICATIONS

Search Report dated Nov. 16, 2017 issued in corresponding DE patent application No. 10 2017 104 400.0 (and English translation).
(Continued)

*Primary Examiner* — Charles G Freay
*Assistant Examiner* — Chirag Jariwala
(74) *Attorney, Agent, or Firm* — Posz Law Group, PLC

(57) ABSTRACT

A pump device for delivery of at least one delivery means, particularly at least one fluid, with at least one drive unit and with at least one delivery device, particularly a delivery membrane comprising at least one, particularly at least substantially annular base body which is elastically deformable and comprises at least one delivery surface arranged on a delivery side of the base body and comprising at least one activation element for connection to at least one drive element of the drive unit, which is arranged on an activation side of the base body, the activation element being designed as a positive or non-positive element that cooperates with the drive element at least for the transfer of a driving force
(Continued)

Figure 1:
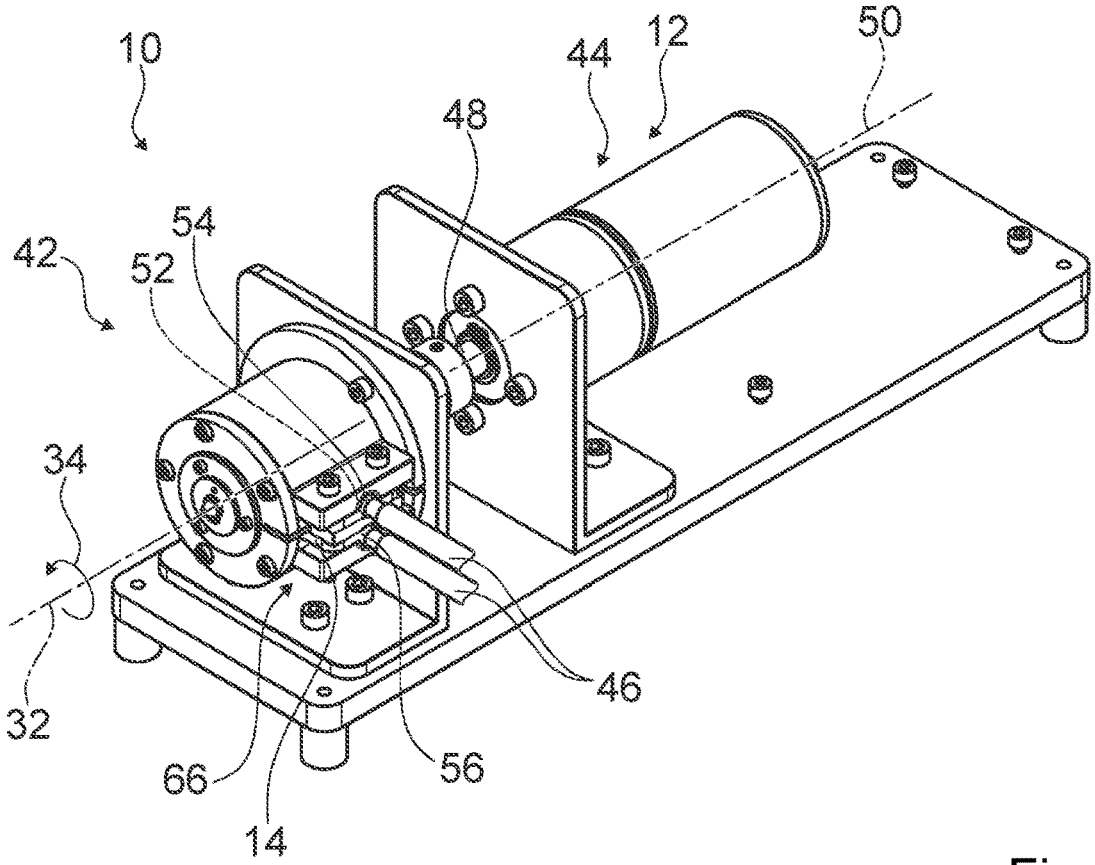

acting in a direction facing away from the activation side, by means of a positive and/or non-positive connection, particularly by means of a positive and/or non-positive connection without adhesive force.

17 Claims, 2 Drawing Sheets

(58) Field of Classification Search
USPC ..... 418/45; 92/101, 129
See application file for complete search history.

(56) References Cited

U.S. PATENT DOCUMENTS

| | | | | |
|---|---|---|---|---|
| 2008/0181800 | A1 | 7/2008 | Muschalek et al. | |
| 2017/0114692 | A1* | 4/2017 | Hodgson | F04C 5/00 |
| 2018/0045048 | A1 | 2/2018 | Braxmaier et al. | |
| 2018/0051564 | A1* | 2/2018 | Braxmaier | F04C 5/00 |

FOREIGN PATENT DOCUMENTS

| | | | |
|---|---|---|---|
| DE | 102015106611 | A1 | 11/2016 |
| WO | 97/29285 | A1 | 8/1997 |
| WO | 2015/140207 | A1 | 9/2015 |

OTHER PUBLICATIONS

International Search Report of the International Searching Authority dated May 30, 2018 issued in corresponding International Patent Application No. PCT/EP2018/055165.

International Preliminary Report on Patentability of the International Searching Authority dated Feb. 12, 2019 issued in corresponding International Patent Application No. PCT/EP2018/055165.

Chinese Office Action dated Feb. 20, 2021, issued in corresponding Chinese Patent Application No. 201880015491.3 (and English Machine Translation).

Canadian Office Action dated Mar. 16, 2021, issued in corresponding Canadian Patent Application No. 3,055,096.

Indian Office Action dated Feb. 25, 2021, issued in corresponding Indian Patent Application No. 201917036353 (and English Machine Translation).

European Decision to Grant dated Apr. 9, 2021, issued in corresponding European Patent Application No. 18711841.9.

Office Action dated May 27, 2021, issued in corresponding RU Patent Application No. 2019130351 (and English Machine Translation).

Office Action dated Sep. 2, 2021 issued in corresponding CA Patent Application No. 3,055,096.

Notification of Grant dated Jul. 27, 2021, issued in corresponding CN Patent Application No. 201880015491.3 (and English Machine Translation).

Office Action dated Dec. 1, 2021 issued in corresponding Japanese patent application No. 2019-547322 (and English translation).

Decision to grant dated Dec. 6, 2021 issued in corresponding Russian patent application No. 2019130351 (and English translation).

Notice of Allowance dated Feb. 1, 2022 issued in corresponding Canadian application No. 3,055,096. Page titled "Commissioner's Notice-Application Found Allowable".

* cited by examiner

PUMP DEVICE FOR DELIVERY OF AT LEAST ONE DELIVERY MEANS

CROSS REFERENCE TO RELATED APPLICATIONS

This application is a U.S. national stage application of PCT/EP2018/055165 filed on Mar. 2, 2018, which is based on German Patent Application No. 10 2017 104 400.0 filed on Mar. 2, 2017, the contents of which are incorporated herein by reference.

PRIOR ART

The invention relates to a pump device for delivering at least one delivery medium, as per the preamble of claim 1.

DE 10 2015 106 611 A1 has already disclosed a pump device for delivering at least one delivery medium, in particular at least one fluid. The known pump device comprises at least one drive unit and at least one delivery device, in particular a delivery diaphragm, which at least one delivery device comprises at least one, in particular substantially ring-shaped, main body which is elastically deformable and which has at least one delivery surface arranged at a delivery side of the main body, and which delivery device comprises at least one activation element for a connection to at least one drive element of the drive unit, which at least one activation element is arranged at an activation side of the main body. The activation element of the known pump device is connected by means of adhesive bonding to the drive element and, for a transmission of a drive force acting in a direction pointing away from the activation side, interacts by means of a cohesive connection with the drive element.

Furthermore, DE 10 2004 011 123 A1 and WO 97/29 285 A1 have already disclosed pump devices for delivering at least one delivery medium, wherein the pump devices comprise at least one drive unit and at least one delivery device, wherein the delivery device comprises at least one main body which is elastically deformable and which has at least one delivery surface arranged at a delivery side of the main body, and which delivery device comprises at least one activation element for a connection to at least one drive element of the drive unit, which at least one activation element is arranged at an activation side of the main body. The activation element is designed as a positively locking (i.e., interlocking) and/or non-positively locking (i.e., non-interlocking) element which, at least for a transmission of a drive force acting in a direction pointing away from the activation side, interacts by means of a positively locking and/or non-positively locking connection, in particular by means of a cohesion-free positively locking and/or non-positively locking connection, with the drive element.

It is the object of the invention in particular to provide a generic device with improved characteristics with regard to an, in particular mechanical, activation of the delivery device and/or a generation of negative pressure by means of the delivery device. The object is achieved according to the invention by means of the features of patent claim 1, whilst advantageous developments and refinements of the invention emerge from the subclaims.

ADVANTAGES OF THE INVENTION

The invention proceeds from a pump device for delivering at least one delivery medium, in particular at least one fluid, having at least one drive unit and having at least one delivery device, in particular a delivery diaphragm, which at least one delivery device comprises at least one, in particular substantially ring-shaped, main body which is elastically deformable and which has at least one delivery surface arranged at a delivery side of the main body, and which delivery device comprises at least one activation element for a connection to at least one drive element of the drive unit, which at least one activation element is arranged at an activation side of the main body, wherein the activation element is designed as a positively locking and/or non-positively locking element which, at least for a transmission of a drive force acting in a direction pointing away from the activation side, interacts by means of a positively locking and/or non-positively locking connection, in particular by means of a cohesion-free positively locking and/or non-positively locking connection, with the drive element.

It is proposed that the activation element has a maximum longitudinal extent smaller than a maximum longitudinal extent of the main body, in particular as viewed along a circumferential direction running around a drive axis of the drive unit. The delivery side of the main body is preferably arranged on a side of the main body averted from the activation side of the main body. In particular, the delivery side forms an outer side of the main body. The activation side preferably forms an inner side of the main body. In particular, the direction pointing away from the activation side runs transversely, in particular at least substantially perpendicularly, with respect to the activation side, in particular with respect to an inner surface of the main body which forms the activation side of the main body. Preferably, the direction pointing away from the activation side runs transversely, in particular at least substantially perpendicularly, with respect to a movement axis, in particular an axis of rotation, of a force exertion element of the drive unit. The direction pointing away from the activation side preferably runs from the activation side in the direction of the drive element. The delivery device, in particular the delivery diaphragm, can preferably be moved away from a counterpart surface of a casing element of a casing of the pump device, in particular lifted off from the counterpart surface, owing to an action of a drive force acting in a direction pointing away from the activation side, in particular in order to generate a negative pressure in a delivery space of the pump device. It is preferably possible, owing to a movement of the delivery device, in particular of the delivery diaphragm, away from the counterpart surface, for a negative pressure to be generated which is in particular lower than −0.1 bar, preferably lower than −0.2 bar and particularly preferably lower than −0.3 bar, in particular in relation to an atmospheric pressure surrounding the pump device. Advantageous delivery of a delivery medium into a delivery space, which is delimited at least partially by the counterpart surface and the delivery surface, of the pump device can be achieved.

Preferably, the delivery device, in particular the delivery diaphragm, can be driven by means of the drive unit such that delivery of a delivery medium, in particular of a fluid, in accordance with a travelling wave principle (see for example the disclosure of EP 1 317 626 B1) can be made possible. The drive unit may be designed as a mechanical drive unit, as a magnetic drive unit, as a piezoelectric drive unit, as a hydraulic drive unit, as a pneumatic drive unit, as an electric drive unit, as a magnet rheological drive unit, as a carbon tubes drive unit, as a combination of any of the stator types of drive units, or as some other drive unit that appears expedient to a person skilled in the art. The drive unit preferably comprises at least the drive element, which is provided for acting on the delivery device, in particular the delivery diaphragm. It is however also conceivable for the drive unit to have a number of drive elements that differs from one, which drive elements are provided for acting on the delivery device. The drive element is preferably provided for effecting an elastic deformation of the delivery device, in particular of the delivery diaphragm, owing to an action of a drive force on the delivery device, in particular the delivery diaphragm. The drive element may have any form that appears expedient to a person skilled in the art, such as for example a form as a plunger, as a projection, as an engaging ring, as a hook, as a gripping element or the like. The drive unit preferably comprises at least one electric motor unit, which is provided in particular for driving at least the drive element. It is however also conceivable for the drive unit to have some other motor unit that appears expedient to a person skilled in the art, such as for example a combustion motor unit, a hybrid motor unit or the like.

The drive unit preferably comprises an eccentric unit for driving the drive element. It is however also conceivable for the drive unit to comprise some other unit that appears expedient to a person skilled in the art for driving the drive element, such as for example a coil unit, a paternoster unit, a plate disk unit or the like. Here, a "coil unit" is to be understood to mean in particular a unit which comprises at least one force exertion element in coil form, which is provided in particular for exerting a drive force, in particular directly exerting a drive force, on the drive element. Here, a "paternoster unit" is to be understood to mean in particular a unit which has at least one force exertion element which can in particular be driven with circulating drive in order to exert a drive force, in particular directly exert a drive force, on the drive element, wherein, in particular, the force exertion element, in order to exert a drive force on the drive element, extends at least substantially parallel to a circulation plane, in particular in the circulation plane, in which the force exertion element can be driven in circulation. Here, a "plate disk unit" is to be understood to mean in particular a unit which comprises at least one force exertion element which, in particular in order to exert a drive force, in particular directly exert a drive force, on the drive element, is arranged on a plate element which can be driven in rotation, wherein, in particular, the force exertion elements, in order to exert a drive force on the drive element, extends at least substantially parallel or at least substantially perpendicular to an axis of rotation of the plate element. The expression "substantially perpendicular" is intended to define in particular an orientation of a direction relative to a reference direction, wherein the direction and the reference direction, in particular as viewed in a plane, enclose an angle of 90°, and the angle has a maximum deviation of in particular less than 8°, advantageously less than 5° and particular advantageously less than 2°. "Substantially parallel" is to be understood to mean in particular an orientation of a direction relative to a reference direction, in particular in a plane, wherein the direction has a deviation of in particular less than 8°, advantageously less than 5°, and particularly advantageously less than 2°, in relation to the reference direction.

The drive unit preferably comprises at least one force exertion element which is formed as an eccentric and which interacts with the drive element. The force exertion element is preferably connected rotationally conjointly to a drive shaft of the drive unit, in particular is formed integrally with the drive shaft. The drive shaft can preferably be driven in rotation by means of the motor unit, in particular the electric motor unit, of the drive unit. The drive shaft, in particular at least the force exertion element, is preferably mounted so as to be movable, in particular rotatable, relative to the drive element. A bearing element of the drive unit is preferably arranged between the drive element and the drive shaft, in particular the force introduction element. The drive element is preferably provided for acting directly on the delivery device, in particular the delivery diaphragm. The drive element is preferably connected in positively locking and/or non-positively locking fashion to the delivery device, in particular the delivery diaphragm, preferably to the activation element. It is however also conceivable for at least one further element or further elements of the pump device to be arranged between the drive element and the delivery device, in particular the delivery diaphragm, preferably the activation element, such as for example a friction-reducing element, a bearing element, a protection element which is provided for protecting an outer surface of the delivery device, in particular of the delivery diaphragm, preferably of the activation element, owing to an action of the drive element on the delivery device, in particular the delivery diaphragm, or the like. "Integrally" is to be understood in particular to mean at least cohesively connected, for example by means of a welding process, an adhesive bonding process, a molding-on process and/or some other process that appears expedient to a person skilled in the art, and/or advantageously formed in one piece, for example by production from one casting, by production in a single-component or multi-component injection molding process, and/or by means of a vulcanization process, and advantageously from a single blank.

At least one drive axis of the drive unit, in particular an axis of rotation of the drive shaft, advantageously runs transversely, in particular at least substantially perpendicularly, with respect to a delivery direction of the delivery device, in particular of the delivery diaphragm, in particular with respect to a delivery direction in the delivery space, which is delimited at least partially by the delivery surface, of the pump device. An axis of rotation of a rotor element of the electric motor unit of the drive unit preferably runs at least substantially parallel, in particular coaxially, with respect to the drive axis of the drive unit. The delivery space of the pump device is preferably delimited by the main body of the delivery device and the casing element of the casing of the pump device. The delivery space of the pump device is preferably delimited by the delivery surface and by the counterpart surface, situated opposite the delivery surface, of the casing element of the casing of the pump device. The casing element is preferably formed as a dimensionally stable, in particular rigid, casing element. "Dimensionally stable" is to be understood in particular to mean that the casing element is preferably formed so as to be, in terms of shape, resistant to pressure, heat and/or the like.

The delivery device, in particular the delivery diaphragm, is preferably of resiliently elastic form. "Resiliently elastic" is to be understood in particular to mean a characteristic of an element, in particular of the delivery device, which is provided in particular for a generation of an opposing force which is dependent on a change in a shape of the element and which is preferably proportional to the change and which counteracts the change. The delivery device, in particular the delivery diaphragm, is preferably repeatably deformable, in particular without the delivery device, in particular the delivery diaphragm, being mechanically damaged or destroyed as a result. The delivery device, in particular the delivery diaphragm, preferably seeks, in particular after a deformation, to automatically re-assume a basic shape, in particular a convexly curved basic shape in relation to the counterpart surface, in particular a zero position, of the delivery device, in particular of the delivery diaphragm. The resiliently elastic design of the delivery device, in particular of the delivery diaphragm, can preferably be at least partially influenced and/or realized by means of an, in particular geometrical, design of the main body and/or by means of an arrangement of the delivery device, in particular of the delivery diaphragm, on the casing element which has the counterpart surface. The delivery device, in particular the delivery diaphragm, is preferably arranged on the casing element which has the counterpart surface such that delivery of a delivery medium in and/or through the delivery space occurs owing to a bulging of the delivery device, in particular of the delivery diaphragm. After an elimination of an exertion of a drive force on the delivery device, in particular the delivery diaphragm, for a delivery of a delivery medium, the delivery surface of the delivery device, in particular of the delivery diaphragm, seeks to re-assume a convexly curved arrangement in relation to the counterpart surface, preferably at least substantially automatically, in particular owing to the resiliently elastic design. The delivery device, in particular the delivery diaphragm, is preferably formed from a rubber-like and/or natural-rubber-like material. It is however also conceivable for the delivery device, in particular the delivery diaphragm, to be formed from some other material that appears expedient to a person skilled in the art, or from a combination of multiple materials, which permit(s) a resiliently elastic design of the delivery device, in particular of the delivery diaphragm. The delivery device, in particular the delivery diaphragm, preferably utilizes a "bulging effect" for a delivery of a delivery medium in and/or through the delivery space. The delivery device, in particular the delivery surface, can preferably be at least temporarily bulged for the purposes of delivering a delivery medium, wherein at least one bulge can, for the purposes of delivering a delivery medium, be displaced, in particular displaced in rolling fashion, along the delivery surface. "Provided" is to be understood to mean in particular specially designed and/or specially equipped. The statement that an element and/or a unit are/is provided for a particular function is to be understood in particular to mean that the element and/or the unit perform(s) and/or carry/carries out said particular function in at least one state of use and/or operating state.

The pump device preferably comprises at least one delivery medium storage unit for storing a delivery medium, in particular a fluid, which can be delivered by means of the delivery device, in particular the delivery diaphragm. Here, a "delivery medium storage unit" is to be understood to mean in particular a unit which has at least one storage space in which a delivery medium, in particular a fluid, can be stored. A volume of the storage space of the delivery medium storage unit is preferably at least larger than a volume of the delivery space. The delivery medium storage unit is preferably formed in the manner of a tank. The delivery medium storage unit may be formed as a carpule, as a vial, as a cartridge, as a canister or the like. The delivery medium storage unit is preferably connectable in terms of flow to the delivery space of the pump device. The pump device is preferably provided for use in a foodstuffs environment, in a chemistry environment, in a pharmaceutical environment, in particular for batchwise use, in a vivarium environment (aquarium etc.), in a household appliance environment, in a dental hygiene environment, in an automobile environment, in a medical environment, in a water treatment environment or the like.

The main body preferably has a ring-shaped design. The main body preferably has a slotted ring-shaped design. In particular, as viewed in a plane, in particular in a plane running at least substantially perpendicular to the drive axis, the main body has a cross-sectional shape which is substantially made up of a circular arc or an open ring, which extends along an angle range of less than 360° and in particular of more than 90°, and two inlet and/or outlet projections which run transversely with respect to the circular arc or with respect to the open ring and which directly adjoin the circular arc or the open ring, in particular in end regions of the circular arc or of the open ring. The activation element is preferably arranged on the main body, in particular on an inner side of the main body, in the region of a circular arc profile or of a ring profile of the main body. A maximum longitudinal extent of the activation element is in particular at least 5%, preferably 10% and very particularly preferably at least 20% smaller than a maximum longitudinal extent of the main body. The activation element preferably extends at least substantially along an entire extent of the circular arc or of the open ring of the main body, in particular as far as end regions of the circular arc or of the open ring, at each of which there is arranged an inlet and/or outlet projection of the main body. The activation element preferably extends along an angle range in particular of less than 360°, preferably of less than 340° and particularly preferably of more than 180° at the activation side.

By means of the design according to the invention, it is particularly advantageously possible to permit a reliable movement of the delivery surface, in particular away from the counterpart surface, in order to particular advantageously make possible a negative pressure for a delivery of a delivery medium by means of the pump device. It is advantageously possible to realize efficient delivery of a delivery medium owing to a suction movement of the delivery unit by means of an exertion of a drive force, which acts in a direction pointing away from the delivery side, by means of the positively locking and/or non-positively locking connection between the drive element and the activation element. A reliable excitation of the delivery device by the drive element can advantageously be achieved. It is furthermore advantageously possible to realize a reliable sealing function in a region of an inlet and/or outlet of the delivery device, because a recess is formed by the activation element in particular in the region of the inlet and/or outlet. It is advantageously possible to realize efficient delivery of a delivery medium owing to a suction movement of the delivery unit by means of an action of a drive force, which acts in a direction pointing away from the delivery side, by means of the positively locking and/or non-positively locking connection between the drive element and the activation element.

It is furthermore proposed that the drive element interacts with play with the activation element. "Interact/engage into/engage around with play" is to be understood in particular to mean that the drive element, in a state in which it is connected to the activation element, has a movement capability relative to the activation element, in particular without elastic deformation of the activation element and/or of the drive element, along at least a distance in particular greater than 0.01 mm, preferably greater than 0.1 mm, particularly preferably greater than 0.5 mm and very particularly preferably less than 10 mm and/or around an axis through an angle greater than 0.01°, preferably greater than 0.1°, particularly preferably greater than 0.5° and very particularly preferably less than 15°, wherein the movement capability preferably differs from a movement capability owing to a manufacturing tolerance. The drive element, in a state in which it is connected to the activation element, is preferably movable relative to the activation element along a direction running transversely, in particular at least substantially perpendicularly, with respect to the axis of rotation of the drive shaft. In particular, the drive element, in a state in which it is connected to the activation element, is movable relative to the activation element proceeding from a zero position of the delivery device, in particular a delivery-free state of the delivery surface, until the drive element, owing to an exertion of a drive force of the force exertion element on the drive element, is movable in a direction pointing away from the counterpart surface, in particular in the direction of the drive shaft, and abuts against at least one surface of the activation element, which surface is arranged at a region of the activation element which faces toward the drive shaft and which has a minimal spacing to the drive shaft. The drive element, in a state in which it is connected to the activation element, is preferably movable, proceeding from a zero position of the delivery device, at least temporarily independently of the activation element in a direction pointing away from the counterpart surface, in particular in the direction of the drive shaft, in particular until the drive element comes into contact with at least one surface of the activation element, which surface runs, in particular at least in certain regions, at least substantially parallel to the drive axis of the drive unit. Preferably, the activation element, in particular at least after an abutment of the drive element against the at least one surface of the activation element, is movable together with the drive element in a direction pointing away from the counterpart surface, in particular in the direction of the drive shaft, in particular in order to increase a spacing between the delivery surface and the counterpart surface, in particular in order to move the delivery surface in the direction of the output shaft in order to generate a negative pressure in the delivery space. By means of the design according to the invention, it is advantageously possible to realize a low-energy opening movement of the delivery device, in particular because a resiliently elastic design of the delivery device, in particular of the delivery diaphragm, has an assisting action during a resetting movement, in particular into a delivery-free state, of the delivery device, and the delivery device is preferably, during a resetting movement, at least partially decoupled from a forced movement owing to an action of the drive element on the activation element. Efficient delivery of a delivery medium can advantageously be realized. Component-preserving delivery of a delivery medium can advantageously be realized.

It is furthermore proposed that the drive element at least partially engages with play around the activation element, or that the drive element at least partially engages with play into a positive-locking recess, which is delimited by the activation element, of the activation element. It is preferable if the activation element, in the case of being engaged around with play by the drive element, comprises, at least in a partial region of the activation element which is connectable in positively locking and/or non-positively locking fashion to the drive element, a maximum extent along at least one direction, in particular a direction running at least substantially perpendicular to the axis of rotation of the drive shaft, which maximum extent is smaller than a maximum inner extent, running along the direction, of a positive-locking recess of the drive element, to which the partial region of the activation element is connectable in positively locking and/or non-positively locking fashion. In particular, a maximum extent of that partial region of the activation element which is connectable in positively locking and/or non-positively locking fashion to the drive element is at least 1%, preferably at least 5% and particularly preferably at least 10% smaller than the maximum inner extent of the positive-locking recess of the drive element along the direction, in particular the direction running at least substantially perpendicular to the axis of rotation of the drive shaft.

Preferably, in the case of the drive element engaging with play into the activation element, the activation element preferably comprises, at least in a partial region of the activation element which is connectable in positively locking and/or non-positively locking fashion to the drive element, a maximum inner extent of a positive-locking recess of the activation element along at least one direction, in particular a direction running at least substantially perpendicular to the axis of rotation of the drive shaft, which maximum inner extent is smaller than a maximum extent, running along the direction, of a partial region of the drive element which is connectable in positively locking and/or non-positively locking fashion to the activation element, in particular engages in positively locking and/or non-positively locking fashion into the positive-locking recess of the activation element. In particular, a maximum extent of that partial region of the drive element which is connectable in positively locking and/or non-positively locking fashion to the activation element is at least 1%, preferably at least 5% and particularly preferably at least 10% smaller than the maximum inner extent of the positive-locking recess of the activation element along the direction, in particular the direction running at least substantially perpendicular to the axis of rotation of the drive shaft.

The drive element and the activation element may, in the case of one engaging with play around the other and/or in the case of one engaging with play into the other, be connected to one another by means of a connecting facility with play, which is formed for example in the manner of a dovetailed guide with play, in the manner of a ball joint connection with play, or in the manner of some other connecting facility with play that appears expedient to a person skilled in the art. By means of the design according to the invention, it is advantageously possible to realize a low-energy opening movement of the delivery device, in particular because a resiliently elastic design of the delivery device, in particular of the delivery diaphragm, has an assisting action during a resetting movement, in particular into a delivery-free state, of the delivery device and the delivery device is preferably, during a resetting movement, at least partially decoupled from a forced movement owing to an action of the drive element on the activation element. It is particularly advantageously possible to permit a reliable movement of the delivery surface away from the counterpart surface in order to make possible a negative pressure for a delivery of a delivery medium by means of the pump device. Efficient delivery of a delivery medium can advantageously be realized owing to a suction movement of the delivery unit by means of an exertion of a drive force, acting in a direction pointing away from the delivery side, by means of the positively locking and/or non-positively locking connection between the drive element in the activation element.

It is furthermore proposed that the activation element is formed as a projection which engages into a corresponding recess, in particular positive-locking recess, of the drive element or which at least partially delimits a positive-locking recess, into which the drive element at least partially engages, of the activation element. The activation element is preferably formed as a projection which has a T-shaped, a circular, a spherical, a polygonal or similarly formed cross section, which is in particular formed so as to correspond to a geometrical shape of the positive-locking recess that interacts with the projection. The activation element formed as a projection is preferably provided for engaging into a corresponding positive-locking recess of the drive element. Alternatively or in addition, the activation element is formed as a projection which delimits a positive-locking recess of the activation element, into which a projection, such as for example a hook, a ball head or the like, of the drive element engages. The projection is preferably formed integrally with the main body, in particular is molded integrally onto the main body, for example by means of a lamination process, by means of a vulcanization process or the like. By means of the design according to the invention, it is possible in a structurally simple manner to realize a connection, which is releasable in particular for servicing purposes, of the activation element and of the drive element. Efficient delivery of a delivery medium can advantageously be realized owing to a suction movement of the delivery unit by means of an exertion of a drive force, acting in a direction pointing away from the delivery side, by means of the positively locking and/or non-positively locking connection between the drive element and the activation element.

It is furthermore proposed that the activation element is arranged in a connection region of the activation side of the main body, which connection region is arranged between at least two activation regions, which are domed in the direction of the drive element, of the activation side. The domed activation regions are preferably of convex form in relation to the activation side. The connection region is preferably of concave form in relation to the activation side. A dome of the activation regions is preferably formed correspondingly, in particular congruently, with respect to convex regions of the counterpart surface of the casing element. By means of the design according to the invention, it is advantageously possible to realize a central exertion of force by means of the drive element on the delivery device, in particular the delivery diaphragm. Efficient delivery of a delivery medium can advantageously be realized owing to a suction movement of the delivery unit by means of an exertion of a drive force, acting in a direction pointing away from the delivery side, by means of the positively locking and/or non-positively locking connection between the drive element and the activation element.

It is furthermore proposed that the activation side, in particular as viewed in a cross section of the delivery device, in particular in a cross section of the delivery device running in a plane extending at least substantially parallel to a drive axis of the drive unit, has a surface profile which differs from a rectilinear profile and which at least substantially corresponds to, in particular is congruent with, a surface profile of the delivery surface in an at least substantially delivery-free state of the delivery surface. The activation side preferably has, in a partial region, in particular in a partial region which differs from the connection region of the activation side for a connection of the activation element to the drive element, a geometrical design which corresponds to, in particular is congruent with, a geometrical design of at least one partial region of the delivery surface. The surface profile of the delivery surface is preferably of undulating form, in particular with at least two mathematical inflection points. A "delivery-free state" is to be understood in particular to mean a state of the delivery surface in which, in particular as viewed in at least one partial region of the delivery surface, the delivery surface is present in a non-deformed state, in particular in a state of the delivery surface in which it is spaced apart to a maximum extent from a counterpart surface, and, in particular in at least one partial region of the delivery surface, is decoupled from an exertion of a drive force for a delivery of a delivery medium by means of the delivery surface. By means of the design according to the invention, it is advantageously possible to realize component-conserving delivery of a delivery medium. It is advantageously possible to permit a dissipation of stress peaks during an elastic deformation of the delivery device, in particular of the delivery diaphragm. An efficient delivery of a delivery medium can advantageously be realized.

It is furthermore proposed that the activation side, in particular as viewed in a cross section of the delivery device, in particular in a cross section of the delivery device running in a plane extending at least substantially parallel to a drive axis of the drive unit, has, other than in a connection region of the activation side at which the activation element is arranged on the activation side, a domed surface which runs at least substantially parallel to the delivery surface at least in an at least substantially delivery-free state of the delivery surface. By means of the design according to the invention, it is advantageously possible to realize component-conserving delivery of a delivery medium. It is advantageously possible to permit a dissipation of stress peaks during an elastic deformation of the delivery device, in particular of the delivery diaphragm. An efficient delivery of a delivery medium can advantageously be realized.

It is furthermore proposed that the drive element has a drive surface which faces toward the main body and which, in particular as viewed in a cross section of the drive element, in particular in a cross section of the drive element running in a plane extending at least substantially parallel to a drive axis of the drive unit, has a surface profile which differs from a rectilinear profile and which, at least in certain regions, at least substantially corresponds to, in particular is congruent with, a surface profile of the delivery surface in an at least substantially delivery-free state of the delivery surface. The drive element preferably has, in one partial region, in particular in a partial region which differs from a connection region of the drive element for a connection of the drive element to the activation element, a geometrical design which corresponds to, in particular is congruent with, a geometrical design of at least one partial region of the delivery surface. The drive element preferably has a drive surface which faces toward the main body and which, in particular as viewed in a cross section of the drive element, in particular in a cross section of the drive element running in a plane extending at least substantially parallel to a drive axis of the drive unit, has a surface profile which differs from a rectilinear profile and which, at least in certain regions, at least substantially corresponds to, in particular is congruent with, a surface profile of the activation side. The drive element preferably has, in one partial region, in particular in a partial region which differs from a connection region of the drive element for a connection of the drive element to the activation element, a geometrical design which corresponds to, in particular is congruent with, a geometrical design of at least one partial region of the activation side. By means of the design according to the invention, a reliable excitation of the delivery device by means of the drive element can advantageously be achieved. Furthermore, fully areal pressing of the drive element against the activation side can advantageously be realized. Efficient delivery can advantageously be realized.

The invention furthermore proceeds from a delivery device, in particular delivery diaphragm, for a pump device according to the invention, wherein the delivery device comprises at least one, in particular substantially ring-shaped, main body which is elastically deformable and which has at least one delivery surface arranged at a delivery side of the main body, and having at least one activation element which is provided for a connection to at least one drive element of the drive unit and which is arranged at an activation side of the main body, wherein the activation element is designed as a positively locking and/or non-positively locking element which, at least for a transmission of a drive force acting in a direction pointing away from the activation side, is connectable by means of a positively locking and/or non-positively locking connection, in particular by means of a cohesion-free positively locking and/or non-positively locking connection, to the drive element. It is proposed that the activation element has a maximum longitudinal extent smaller than a maximum longitudinal extent of the main body, in particular as viewed along a circumferential direction running around a drive axis of the drive unit, wherein the activation element is arranged on the main body, in particular on an inner side of the main body, in the region of a circular arc profile or of a ring profile of the main body. By means of the design according to the invention, efficient delivery of a delivery medium can advantageously be realized.

The pump device according to the invention and/or the delivery device according to the invention are not intended to be restricted to the use and embodiment described above. In particular, the pump device according to the invention and/or the delivery device according to the invention may, to perform a function described herein, have a number of individual elements, components and units that differs from a number stated herein. Furthermore, where value ranges are stated in this disclosure, values lying within the stated limits are also intended to be disclosed and usable as desired.

DRAWINGS

Further advantages will emerge from the following description of the drawings. The drawings illustrate an exemplary embodiment of the invention. The drawings, the description and the claims contain numerous features in combination. A person skilled in the art will expediently also consider the features individually and combine them to form further meaningful combinations.

Figure 2:
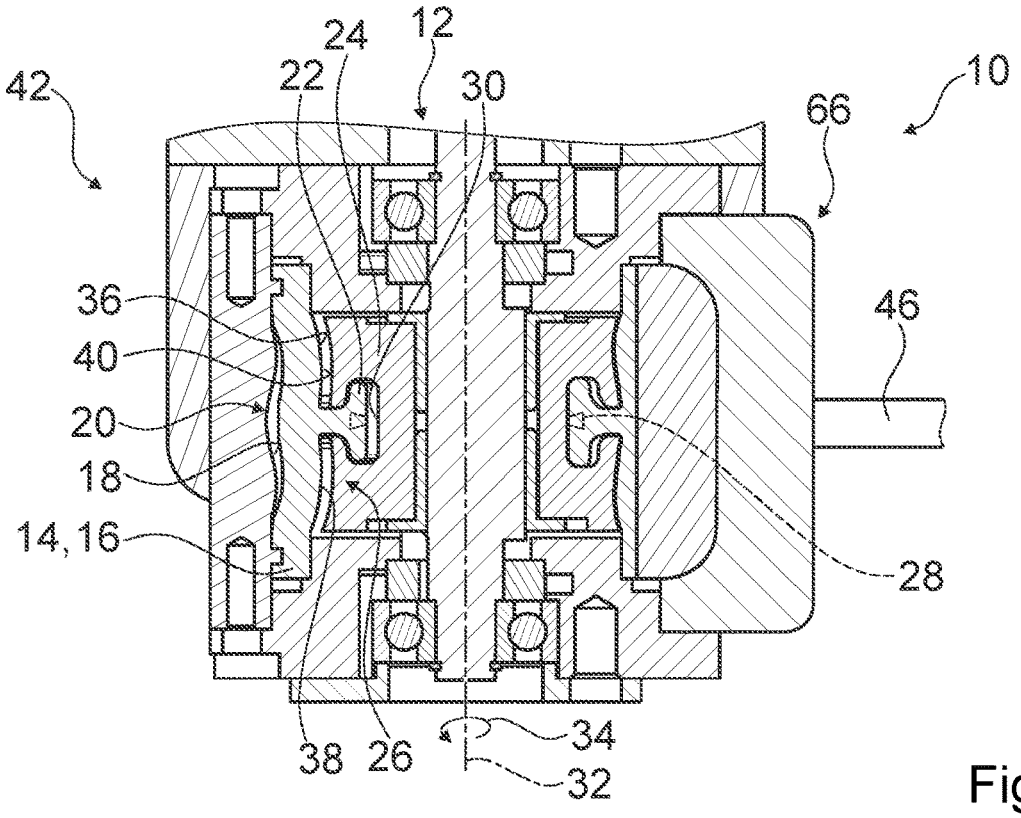
Figure 3:
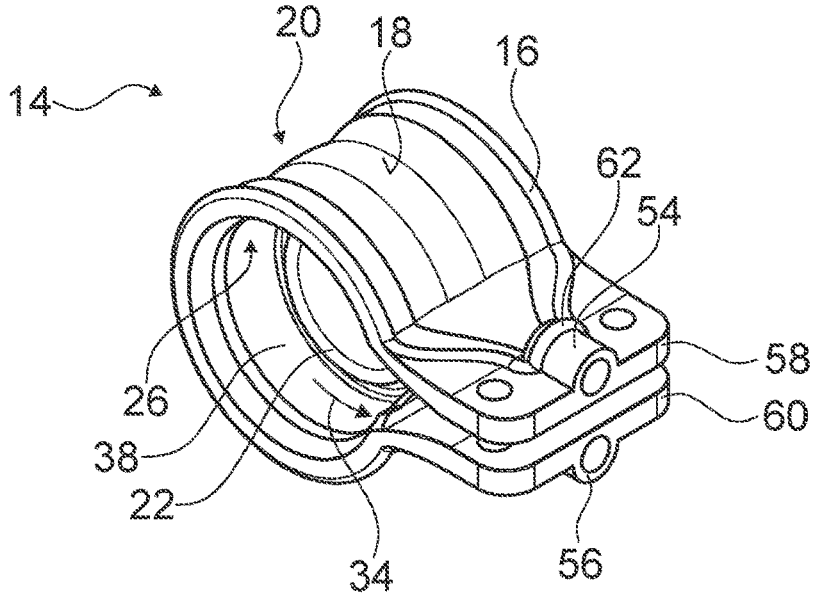
Figure 4:
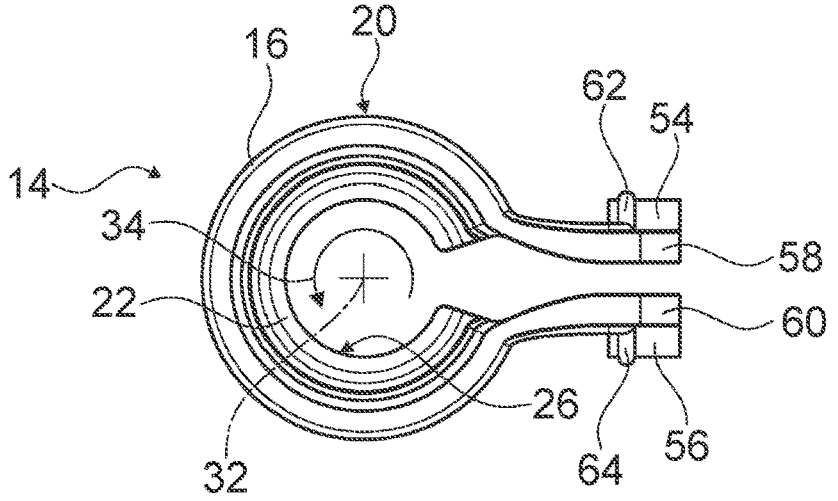
Figure 5:
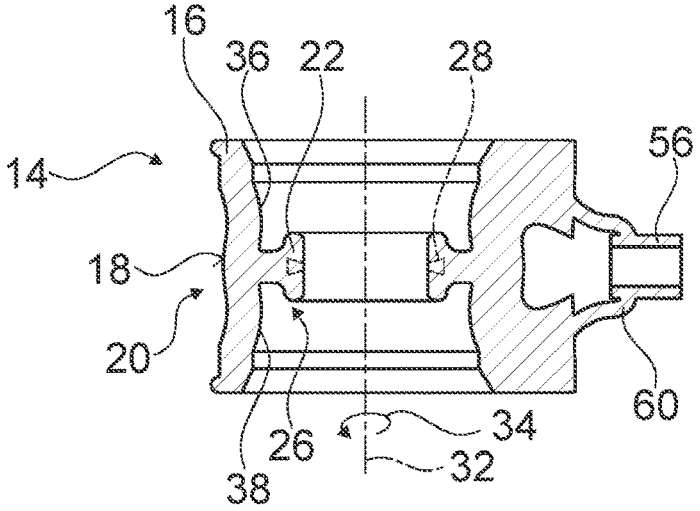

In the drawings:

FIG. 1 shows a pump device according to the invention having at least one delivery device according to the invention in a schematic illustration, FIG. 2 shows a sectional view of the pump device according to the invention and of the delivery device according to the invention, wherein, in a left-hand half of the sectional view, the delivery device has been lifted off from a counterpart surface and, in a right-hand half of the sectional view, the delivery device has been pressed against the counterpart surface in the region of an inlet and/or outlet, in a schematic illustration, FIG. 3 shows a detailed view of the delivery device according to the invention in a state in which it has been dismounted from the pump device according to the invention, in a schematic illustration, FIG. 4 shows a sectional view of the delivery device according to the invention in a schematic illustration, and FIG. 5 shows a further sectional view of the delivery device according to the invention in a schematic illustration.

DESCRIPTION OF THE EXEMPLARY EMBODIMENT

FIG. 1 shows a pump device 10 for delivering at least one delivery medium, in particular at least one fluid. The pump device 10 comprises at least one drive unit 12 and at least one delivery device 14, in particular a delivery diaphragm. The pump device 10 has at least one casing 42. The casing 42 may have any form that appears expedient to a person skilled in the art. In particular, the casing 42 is, in a manner known to a person skilled in the art, provided for at least partially encasing and/or supporting components of the pump device 10, in particular at least the delivery device 14 and/or the drive unit 12.

For open-loop and/or closed-loop control of the drive unit 12, the pump device 10 preferably comprises at least one open-loop and/or closed-loop control unit (not illustrated in any more detail here) which has a configuration already known to a person skilled in the art. The drive unit 12 preferably comprises at least one electric motor unit 44. It is however also conceivable for the drive unit 12 to have some other motor unit that appears expedient to a person skilled in the art, such as for example a combustion motor unit, a hybrid motor unit or the like. A drive element 24 of the drive element 12 for acting on the delivery device 14 may be connected directly, in particular rotationally conjointly, or indirectly, for example via a transmission unit of the pump device 10 or by means of at least one toothed gear element of the pump device 10, to a rotor shaft 48 of the electric motor unit 44. The rotor shaft 48 has an axis of rotation 50 which runs at least substantially parallel, in particular coaxially, with respect to the drive axis 32 of the drive unit 12. Other designs and/or arrangements of the connection between the drive element 24 and the electric motor unit 44 are likewise conceivable, for example a connection by means of an angle transmission unit, by means of a switchable coupling or the like. The pump device 10 furthermore comprises at least one delivery medium storage unit (not illustrated in any more detail here) for storing a delivery medium for delivery, wherein the delivery medium storage unit is connected at least to a delivery line 46 of the pump device 10 for delivery of the delivery medium by means of a delivery space of the pump device 10.

The delivery device 14 comprises at least one, in particular at least substantially ring-shaped, main body 16 (see FIGS. 3 to 5) which is elastically deformable and has at least one delivery surface 18 arranged at a delivery side 20 of the main body 16, and at least one activation element 22 for a connection to the at least one drive element 24 of the drive unit 12, which at least one activation element is arranged at an activation side 26 of the main body 16. The delivery side 20 of the main body 16 is preferably arranged on a side of the main body 16 which faces away from the activation side 26 of the main body 16. In particular, the delivery side 20 forms an outer side of the main body 16, in particular as the in a state of the delivery device 14 in which the latter has been dismounted or removed from the pump device 10. The activation side 26 preferably forms an inner side of the main body 16, in particular as viewed in a state of the delivery device 14 in which the latter has been dismounted or removed from the pump device 10. The activation side 26 in particular at least partially forms an inner surface of the main body 16. The activation element 22 is in particular formed integrally with the main body 16. It is however also conceivable for the activation element 22 to be formed separately from the main body 16 and to be fixed to the main body 16 by means of a positively locking and/or non-positively locking connection that appears expedient to a person skilled in the art.

The activation element 22 is formed as a positively locking and/or non-positively locking element which, at least for a transmission of a drive force acting in a direction pointing away from the activation side 26, interacts by means of a positively locking and/or non-positively locking connection, in particular by means of a cohesion-free positively locking and/or non-positively locking connection, with the drive element 24. The drive element 24 preferably interacts with play with the activation element 22. The drive element 24 at least partially engages with play around the activation element 22 (see FIG. 2). The activation element 22 is formed as a projection which engages into a corresponding recess 30, in particular into a corresponding positive-locking recess, of the drive element 24 (see FIG. 2). Alternatively or additionally, it is also conceivable for the drive element 24 to at least partially engage with play into a positive-locking recess 28 (illustrated by dashed lines in FIG. 5), which is delimited by the activation element 22, of the activation element 22. In an alternative or additional design, it is conceivable for the activation element 22 to be formed as a projection which at least partially delimits the positive-locking recess 28, into which the drive element 24 at least partially engages, of the activation element 22. In an alternative or additional design, it is conceivable for the drive element 24 to comprise a projection, such as for example a hook, a spherical projection or the like, which is provided for engaging into the positive-locking recess 28 (not illustrated in any more detail here).

The activation element 22 has a maximum longitudinal extent which is smaller than a maximum longitudinal extent of the main body 16, in particular as viewed along a circumferential direction 34 running around the drive axis 34 of the drive unit 12.

The main body 16 of the delivery device 14 preferably has a ring-shaped design. The main body 16 preferably has a slotted ring-shaped design. In particular, as viewed in a plane, in particular in a plane running at least substantially perpendicular to the drive axis 32, the main body 16 has a cross-sectional shape which is substantially made up of a circular arc or an open ring and two inlet and/or outlet projections which run transversely with respect to the circular arc or with respect to the open ring. The circular arc or the open ring of the cross-sectional shape of the main body 16 preferably extends along an angle range of less than 360° and in particular of more than 90°. The inlet and/or outlet projections, which run transversely with respect to the circular arc or with respect to the open ring, of the cross-sectional shape of the main body 16 are preferably arranged directly on the circular arc or the open ring, in particular in end regions of the circular arc or of the open ring. The activation element 22 is preferably arranged on the main body 16, in particular on an inner side of the main body 16, in the region of a circular arc profile or of a ring profile of the main body 16. A maximum longitudinal extent of the activation element 22 is in particular at least 5%, preferably 10% and very particularly preferably at least 20% smaller than a maximum longitudinal extent of the main body 16. The activation element 22 preferably extends at least substantially along an entire extent of the circular arc or of the open ring of the main body 16, in particular as far as end regions of the circular arc or of the open ring, at each of which there is arranged an inlet and/or outlet projection of the main body 16. The activation element 22 preferably extends along an angle range in particular of less than 360°, preferably of less than 340° and particularly preferably of more than 180° at the activation side 26.

The activation element 22 is arranged in a connection region of the activation side 26 of the main body 16, which connection region is arranged between at least two activation regions 36, 38, which are domed in the direction of the drive element 24, of the activation side 26. The activation side 26, in particular as viewed in a cross section of the delivery device 14, in particular in a cross section of the delivery device 14 running in a plane extending at least substantially parallel to the drive axis 32 of the drive unit 12, has a surface profile which differs from a rectilinear profile and which at least substantially corresponds to, in particular is congruent with, a surface profile of the delivery surface 18 in a substantially delivery-free state of the delivery surface 18. The activation side 26, in particular as viewed in a cross section of the delivery device 14, in particular in a cross section of the delivery device 14 running in a plane extending at least substantially parallel to a drive axis 32 of the drive unit 12, has, other than in a connection region of the activation side 26 at which the activation element 22 is arranged on the activation side 26, a domed surface which runs at least substantially parallel to the delivery surface 18 at least in an at least substantially delivery-free state of the delivery surface 18. The drive element 24 has a drive surface 40 which faces toward the main body 16 and which, in particular as viewed in a cross section of the drive element 24, in particular in a cross section of the drive element 24 running in a plane extending at least substantially parallel to a drive axis 32 of the drive unit 12, has a surface profile which differs from a rectilinear profile and which, at least in certain regions, at least substantially corresponds to, in particular is congruent with, a surface profile of the delivery surface 18 in an at least substantially delivery-free state of the delivery surface 18.

The delivery device 14 comprises at least one inlet and/or outlet 54, 56 which is formed integrally with the main body 16 and which serves for a connection to at least the delivery line 46 of the pump device 10 which is arranged adjacent to the delivery surface 18 (see FIGS. 3 to 5). The inlet and/or outlet 54, 56 is preferably arranged on, or forms, one of the inlet and/or outlet projections of the main body 16. The delivery device 14 preferably comprises at least one inlet 54, which is formed integrally with the main body 16, and one outlet 56, which is formed integrally with the main body 16. The at least one outlet 56 formed integrally with the main body 16 preferably forms one inlet and/or outlet projection of the inlet and/or outlet projections of the main body 16, or is arranged integrally on one of the inlet and/or outlet projections of the main body 16. The at least one inlet 54 formed integrally with the main body 16 preferably forms a further inlet and/or outlet projection of the inlet and/or outlet projections of the main body 16, or is arranged integrally on one of the inlet and/or outlet projections of the main body 16.

The at least one inlet and/or outlet 54, 56 is formed in particular as a connection interface which is provided for a positively locking and/or non-positively locking connection to at least one partial region of the delivery line 46 of the pump device 10, in particular for receiving, in positively locking and/or non-positively locking fashion, at least one coupling element (not illustrated in any more detail here), such as for example a hose connector or the like, of the delivery line 46 of the pump device 10. The coupling element is preferably designed such that it can be pushed or plugged into the inlet and/or outlet 54, 56. The at least one inlet and/or outlet 54, 56 is formed as a projection of tubular or hose-like form.

The at least one inlet and/or outlet 54, 56 is arranged on at least one fixing projection 58, 60 of the main body 16. The fixing projection 58, 60 is preferably formed integrally with the inlet and/or outlet projection of the main body 16. The fixing projection 58, 60 extends, proceeding from the circular arc or the open ring of the main body 16, transversely with respect to the outer side with respect to the delivery surface 18 of the main body 16. By means of the fixing projection 58, 60, the main body 16, in particular the delivery diaphragm, can be fixed, in particular clamped, on the casing 42 of the pump device 10. The delivery device 14 comprises at least one securing element 62, 64 which is arranged on the at least one inlet and/or outlet 54, 56 and which is provided for securing the at least one inlet and/or outlet 54, 56 on the casing 42 of the pump device 10 in positively locking and/or non-positively locking fashion. The securing element 62, 64 is preferably formed as a securing collar. It is however also conceivable for the securing element 62, 64 to have some other form that appears expedient to a person skilled in the art. The securing element 62, 64 is formed integrally with the at least one inlet and/or outlet 54, 56, in particular formed as a vulcanized projection or collar integrally with the at least one inlet and/or outlet 54, 56. A securing element 62 is preferably arranged at the inlet 54, in particular formed integrally with the inlet 54. A securing element 64 is preferably arranged at the outlet 56, in particular formed integrally with the outlet 56.

The delivery surface 18 of the main body 16 tapers, preferably at least in a region adjacent to the at least one inlet and/or outlet 54, 56, in the direction of the inlet and/or outlet 54, 56 (see FIG. 3). The delivery surface 18 has, in particular in a vicinity of the inlet and/or outlet 54, 56, a spacing, which decreases in the direction of the inlet and/or outlet 54, 56, of two boundary lines that delimit the delivery surface 18 of the main body 16. The delivery space runs in funnel-shaped fashion in a vicinity of the inlet and/or outlet 54, 56. The delivery space preferably transitions in funnel-shaped form into the inlet and/or outlet 54, 56.

The pump device 10 comprises in particular at least the delivery device 14, which is formed as a delivery diaphragm, at least the drive unit 12 for acting on the delivery diaphragm, and at least the casing 42, which has at least one clamping interface 66 for receiving the at least one inlet and/or outlet 54, 56, formed integrally with the main body 16, of the delivery device 14, in particular of the delivery diaphragm. The at least one clamping interface 66 comprises at least one positive-locking element 52, in particular a securing recess, which is connected in positively locking and/or non-positively locking fashion at least to the securing element 62, 64, arranged at the at least one inlet and/or outlet 54, 56, of the delivery device 14, in particular of the delivery diaphragm. The positive-locking element 52 is preferably formed as a groove in the casing 42 of the pump device 10, which groove interacts with the securing element 62, 64 arranged at the at least one inlet and/or outlet 54, 56. It is however also conceivable for the securing element 62, 64 to be formed as a groove and for the positive-locking element 52 of the clamping interface 66 to be formed as a projection or web that engages into the securing element 62, 64 formed as a groove.

REFERENCE DESIGNATIONS

10 Pump device
12 Drive unit
14 Delivery device
16 Main body
18 Delivery surface
20 Delivery side
22 Activation element
24 Drive element
26 Activation side
28 Positive-locking recess
30 Recess
32 Drive axis
34 Circumferential direction
36 Activation region
38 Activation region
40 Drive surface
42 Casing
44 Electric motor unit
46 Delivery line
48 Rotor shaft
50 Axis of rotation
52 Positive-locking element
54 Inlet and/or outlet
56 Inlet and/or outlet
58 Fixing projection
60 Fixing projection
62 Securing element
64 Securing element
66 Clamping interface

The invention claimed is:

1. A delivery device for a pump device, having at least one ring-shaped main body which is elastically deformable and which has at least one delivery surface arranged at a delivery side of the at least one ring-shaped main body, and having at least one activation element which is provided for a connection to at least one drive element of the pump device and which is arranged at an activation side of the at least one ring-shaped main body, wherein the at least one activation element is designed as one of an interlocking element and a non-interlocking element which, at least for a transmission of a drive force acting in a direction pointing away from the activation side of the at least one ring-shaped main body, is connectable by means of one of an interlocking connection and non-interlocking connection to the at least one drive element, wherein the direction pointing away from the activation side of the at least one ring-shaped main body runs at least perpendicularly with respect to a movement axis of the at least one drive element of a drive unit, wherein the at least one activation element has a maximum longitudinal extent smaller than a maximum longitudinal extent of the at least one ring-shaped main body, as viewed along a circumferential direction running around a drive axis of the drive unit, wherein the at least one activation element is arranged on an inner side of the at least one ring-shaped main body in a region of a circular arc profile or of a ring profile of the at least one ring-shaped main body, wherein the activation side of the at least one ring-shaped main body as viewed in a cross section of the delivery device running in a plane extending parallel to the drive axis of the drive unit, has, other than in a connection region of the activation side of the at least one ring-shaped main body at which the at least one activation element is arranged on the activation side of the at least one ring-shaped main body, a domed surface which runs parallel to the at least one delivery surface at least in a delivery-free state of the at least one delivery surface.

2. A delivery device for a pump device, having at least one ring-shaped main body which is elastically deformable and which has at least one delivery surface arranged at a delivery side of the at least one ring-shaped main body, and having at least one activation element which is provided for a connection to at least one drive element of the pump device and which is arranged at an activation side of the at least one ring-shaped main body, wherein the at least one activation element is designed as one of an interlocking element and a non-interlocking element which, at least for a transmission of a drive force acting in a direction pointing away from the activation side of the at least one ring-shaped main body, is connectable by means of one of an interlocking connection and non-interlocking connection to the at least one drive element, wherein the direction pointing away from the activation side of the at least one ring-shaped main body runs at least perpendicularly with respect to a movement axis of the at least one drive element of a drive unit, wherein the at least one activation element has a maximum longitudinal extent smaller than a maximum longitudinal extent of the at least one ring-shaped main body, as viewed along a circumferential direction running around a drive axis of the drive unit, wherein the at least one activation element is arranged on an inner side of the at least one ring-shaped main body in a region of a circular arc profile or of a ring profile of the at least one ring-shaped main body, wherein the at least one drive element has a drive surface which faces toward the at least one ring-shaped main body and which, as viewed in a cross section of the at least one drive element running in a plane extending parallel to the drive axis of the drive unit, has a surface profile which differs from a rectilinear profile and which, at least in certain regions, at least substantially corresponds to surface profile of the at least one delivery surface in a delivery-free state of the at least one delivery surface.

3. A pump device for delivering at least one delivery medium, having at least one drive unit and having at least one delivery device, wherein the at least one delivery device comprises at least one ring-shaped main body which is elastically deformable and which has at least one delivery surface arranged at a delivery side of the at least one ring-shaped main body, wherein the at least one delivery device comprises at least one activation element for a connection to at least one drive element of the at least one drive unit, wherein the at least one activation element is arranged at an activation side of the at least one ring-shaped main body, wherein the at least one activation element is designed as one of an interlocking element and a non-interlocking element which, at least for a transmission of a drive force acting in a direction pointing away from the activation side of the at least one ring-shaped main body, interacts by means of one of an interlocking connection and a non-interlocking connection with the at least one drive element, wherein the direction pointing away from the activation side of the at least one ring-shaped main body runs at least perpendicularly with respect to a movement axis of the at least one drive element of the at least one drive unit, wherein the at least one activation element has a maximum longitudinal extent smaller than a maximum longitudinal extent of the at least one ring-shaped main body, as viewed along a circumferential direction running around a drive axis of the at least one drive unit, wherein the activation side of the at least one ring-shaped main body as viewed in a cross section of the at least one delivery device running in a plane extending parallel to the drive axis of the at least one drive unit, has, other than in a connection region of the activation side of the at least one ring-shaped main body at which the at least one activation element is arranged on the activation side of the at least one ring-shaped main body, a domed surface which runs parallel to the at least one delivery surface at least in a delivery-free state of the at least one delivery surface.

4. The pump device according to claim 3, wherein the at least one activation element is formed as a projection which engages into a corresponding recess of the at least one drive element, or wherein the at least one activation element at least partially delimits an interlocking recess, into which the at least one drive element at least partially engages, of the at least one activation element.

5. The pump device according to claim 3, wherein the at least one activation element is arranged on the at least one ring-shaped main body in the region of a circular arc profile or of a ring profile of the at least one ring-shaped main body.

6. The pump device according to claim 3, wherein the at least one activation element is arranged in a connection region of the activation side of the at least one ring-shaped main body, the connection region is arranged between at least two activation regions, which are domed in a direction of the at least one drive element, of the activation side of the at least one ring-shaped main body.

7. The pump according to claim 3, wherein the activation side of the at least one ring-shaped main body as viewed in a cross section of the at least one delivery device running in a plane extending parallel to the drive axis of the at least one drive unit, has a surface profile which differs from a rectilinear profile and which at least substantially corresponds to a surface profile of the at least one delivery surface in a delivery-free state of the at least one delivery surface.

8. The pump device according to claim 3, wherein the at least one drive element has a drive surface which faces toward the at least one ring-shaped main body and which, as viewed in a cross section of the at least one drive element running in a plane extending parallel to the drive axis of the at least one drive unit, has a surface profile which differs from a rectilinear profile and which, at least in certain regions, at least substantially corresponds to surface profile of the at least one delivery surface in a delivery-free state of the at least one delivery surface.

9. The pump device according to claim 3 wherein the at least one drive element interacts with play with the at least one activation element.

10. The pump device according to claim 9, wherein the at least one drive element at least partially engages with play around the at least one activation element, or wherein the at least one drive element at least partially engages with play into an interlocking recess, which is delimited by the at least one activation element, of the at least one activation element.

11. A pump device for delivering at least one delivery medium, having at least one drive unit and having at least one delivery device, wherein the at least one delivery device comprises at least one ring-shaped main body which is elastically deformable and which has at least one delivery surface arranged at a delivery side of the at least one ring-shaped main body, wherein the at least one delivery device comprises at least one activation element for a connection to at least one drive element of the at least one drive unit, wherein the at least one activation element is arranged at an activation side of the at least one ring-shaped main body, wherein the at least one activation element is designed as one of an interlocking element and a non-interlocking element which, at least for a transmission of a drive force acting in a direction pointing away from the activation side of the at least one ring-shaped main body, interacts by means of one of an interlocking connection and a non-interlocking connection with the at least one drive element, wherein the direction pointing away from the activation side of the at least one ring-shaped main body runs at least perpendicularly with respect to a movement axis of the at least one drive element of the at least one drive unit, wherein the at least one activation element has a maximum longitudinal extent smaller than a maximum longitudinal extent of the at least one ring-shaped main body, as viewed along a circumferential direction running around a drive axis of the at least one drive unit, wherein the at least one drive element has a drive surface which faces toward the at least one ring-shaped main body and which, as viewed in a cross section of the at least one drive element running in a plane extending parallel to the drive axis of the at least one drive unit, has a surface profile which differs from a rectilinear profile and which, at least in certain regions, at least substantially corresponds to surface profile of the at least one delivery surface in a delivery-free state of the at least one delivery surface.

12. The pump device according to claim 11, wherein the at least one activation element is arranged in a connection region of the activation side of the at least one ring-shaped main body, the connection region is arranged between at least two activation regions, which are domed in a direction of the at least one drive element, of the activation side of the at least one ring-shaped main body.

13. The pump according to claim 11, wherein the activation side of the at least one ring-shaped main body as viewed in a cross section of the at least one delivery device running in a plane extending parallel to the drive axis of the at least one drive unit, has a surface profile which differs from a rectilinear profile and which at least substantially corresponds to a surface profile of the at least one delivery surface in a delivery-free state of the at least one delivery surface.

14. The pump device according to claim 11, wherein the at least one activation element is formed as a projection which engages into a corresponding recess of the at least one drive element, or wherein the at least one activation element at least partially delimits an interlocking recess, into which the at least one drive element at least partially engages, of the at least one activation element.

15. The pump device according to claim 11, wherein the at least one activation element is arranged on the at least one ring-shaped main body in the region of a circular arc profile or of a ring profile of the at least one ring-shaped main body.

16. The pump device according to claim 11 wherein the at least one drive element interacts with play with the at least one activation element.

17. The pump device according to claim 16, wherein the at least one drive element at least partially engages with play around the at least one activation element, or wherein the at least one drive element at least partially engages with play into an interlocking recess, which is delimited by the at least one activation element, of the at least one activation element.

* * * * *